United States Patent [19]

Briley

[11] Patent Number: 4,595,344

[45] Date of Patent: Jun. 17, 1986

[54] EJECTOR AND METHOD OF CONTROLLING SAME

[76] Inventor: Patrick B. Briley, 208 NW. 44th, #F, Lawton, Okla. 73505

[21] Appl. No.: 429,279

[22] Filed: Sep. 30, 1982

[51] Int. Cl.[4] ..... F04F 5/48

[52] U.S. Cl. ..... 417/185; 239/546; 417/183; 417/184; 417/187; 417/189; 417/198

[58] Field of Search ..... 417/151, 182, 183, 184, 417/185, 187, 189, 188, 198, 196; 239/546, 602; 60/235, 239, 242

[56] References Cited

U.S. PATENT DOCUMENTS

| | | | |
|---|---|---|---|
| 930,095 | 8/1909 | Seagrave | 239/546 |
| 1,459,961 | 6/1923 | Wheeler | 417/159 |
| 1,596,523 | 8/1926 | Friedmann | 417/184 |
| 2,269,318 | 1/1942 | Pedrick | 417/192 X |
| 2,623,474 | 12/1952 | Friedmann | 417/178 |
| 2,959,355 | 11/1960 | Houser | 239/546 X |
| 3,143,293 | 8/1964 | Purse | 417/189 X |
| 3,441,045 | 4/1969 | Malone | 417/189 X |
| 3,448,691 | 6/1969 | Frazier | 417/189 |
| 3,776,470 | 12/1973 | Tsuchiya | 239/546 X |

*Primary Examiner*—Edward K. Look

[57] ABSTRACT

An adjustable ejector capable of adjusting the fluid flow conditions resulting from fluid flow through the ejector. Adjustment means are provided for varying the fluid presentation size ratio of the inlet nozzle throat to the mixing throat. The adjustment means includes at least one adjustable path structure disposed in either the inlet nozzle or the mixing throat, or both.

2 Claims, 23 Drawing Figures

EJECTOR AND METHOD OF CONTROLLING SAME

BACKGROUND OF THE INVENTION

1. Field of the Invention

This invention relates generally to pumps for pumping fluids and more particularly to ejector pumps for pumping fluids.

2. Description of the Prior Art

Ejector pumps are well known devices for pumping fluids. Ejectors utilize motive fluid to pump a second fluid. The motive fluid enters the ejector through a motive inlet which narrows to an inlet nozzle. This nozzle ejects the motive fluid at high velocity into a mixing section. The pumped fluid enters the ejector through a suction inlet which is communicated with the mixing section. The second fluid entering the mixing section from the suction inlet is entrained by the high velocity motive fluid thereby pumping the second fluid. The static pressure of the combined fluids leaving the mixing section may be increased if desired by including a diffuser section downstream of the mixing section. The combined fluids are discharged from the ejector via the diffuser or via the mixing section if no diffuser is provided.

Ejector performance and ejector efficiency are strongly influenced by ejector design and the condition of fluids which enter and leave the ejector. The pressures and mass flow rates achieved for the motive, suction and discharge fluids are measures of ejector performance. The ejector efficiency can be defined in terms of the ratio of mass flow rates for motive and suction fluid flows for fixed motive, suction and discharge pressures. An ejector which can pump at higher mass flow rates from the suction side with less mass flow to the motive side at constant inlet and outlet pressure conditions is said to be more efficient.

Presently, ejector design parameters such as nozzle and mixing section throat diameters are selected and fixed based on assumed average or constant design conditions of fluid at the ejector inlets and outlet. For example, under constant motive inlet conditions an ejector having a particular mixing throat size and a particular inlet nozzle size and configuration will produce the desired design pumping and fluid conditions at the ejector suction and ejector outlet or discharge. In some instances, two stage or three stage ejectors must be utilized to achieve the desired design conditions.

Although ejectors have been found suitable for many types of pumping requirements, serious deficiencies in ejector performance and efficiency result when fluid conditions at the ejector openings fluctuate outside the range of design conditions. In the past, an attempt has been made to reduce these deficiencies by utilizing an ejector which is designed for average fluid conditions somewhere near the middle of the expected fluctuating fluid conditions.

However, if fluid conditions at the ejector inlets and outlet are not the average conditions which were expected when the ejector was selected or designed, the prior art ejectors often will work less efficiently and will not achieve the performance desired. For example, as motive fluid pressure drops the amount of suction mass flow rate and pressure will increase in order to maintain the desired discharge pressure. If the motive fluid pressure drops too low, the ejector will either stop pumping or will generate sputtering discharge flows with oscillating discharge pressure. To assure continued flow in the discharge line, often the ejector must be augmented or backed up with a mechanical gas compressor. Even when the ejector is still providing desired discharge pressures, the energy required to drive the ejector will be increased and the ejector efficiency will be reduced because the inlet and suction pressures and flows are different than the conditions for which the nozzle and mixing throat diameters were selected.

Another deficiency of ejectors has been the large increase in size and cost of ejectors capable of handling fluids at pressures greater than 200–300 psi. For low pressure applications, relatively low strength castings which require minor amounts of machining can be used for ejectors. At high pressures, however, thick, high strength forgings and alloys requiring significant machining must be used. The need for machining results from creating the detailed internal features of the ejector.

SUMMARY OF THE INVENTION

It is accordingly an object of the present invention to provide an improved ejector, particularly an adjustable ejector capable of adjusting the fluid flow conditions resulting from fluid flow through the ejector.

It is also an object of the present invention to provide an adjustable ejector which can be adjusted to be more efficient when fluid flow conditions change over a wide range.

It is another object of the invention to provide an adjustable ejector for controlling the fluid flow conditions at one or more of the inlet and outlets of the ejectors during changes in the conditions of fluid flow at these inlets and outlets.

As an additional object, the invention provides a method for improving ejector process performance by automatically and continuously controlling fluid conditions at the openings of an ejector used in a process with a combination of adjustment means for the ejector inlet nozzle and/or mixing throat diameters and process adjustment means (external to the ejector) for one or more of the fluid conditions at one or more of the ejector openings.

A final object of this invention is the achievement of a higher rated pressure capability for inexpensive ejectors designed and made for lower rated pressure service. This objective can be achieved as a complementary advantage for an ejector equipped with pressure housings to prevent leakage around inlet nozzle and mixing throat adjustment means.

In accordance with these objects, the adjustable ejector of the present invention comprises an ejector housing having a motive inlet including an inlet nozzle, a suction inlet and a mixing and outlet zone wherein mixing of fluid from the motive inlet and suction inlet occur and then exits from the ejector. The mixing and outlet zone includes a mixing throat and may include a diffuser. Adjustment means are provided for varying the fluid presentation size ratio of the inlet nozzle throat to the mixing throat such that fluid flow conditions with respect to the motive inlet, suction inlet and mixing and outlet zone can be controlled thereby. The adjustment means includes at least one adjustable fluid path structure disposed in either the inlet nozzle or the mixing throat, or both.

In one embodiment, the adjustable fluid path structure comprises a conical shaped nozzle having a splined outlet and disposed for receiving and conveying fluid passing into and through the inlet nozzle. A spline movement means is provided for adjusting the splined outlet to vary the fluid presentation size of the splined nozzle throat.

In another embodiment, the adjustable fluid path structure comprises segments disposed in and defining the throat of the ejector mixing section. These segments are movable with respect to each other and such movement changes the fluid presentation size of the mixing section throat.

By controlling one or both of the above described embodiments or alternate embodiments to achieve the same effect, the ratio of the fluid presentation size of the ejector inlet nozzle throat to the ejector mixing throat can be adjusted. Preferably, this control is resposive to fluid conditions either in the ejector or effecting the ejector. This allows adjusting the ejector to change the fluid flow conditions resulting from flow through the ejector instead of vice versa. By this means, optimum fluid flow conditions can be achieved or the ejector can continue to operate efficiently at varying fluid flow conditions.

The present invention also utilizes a high pressure rated housing to surround and seal an ejector to achieve the complementary results of both increasing the pressure rating of the ejector and providing a seal for the nozzle inlet and/or mixing throat adjusting parts attached to the ejector. Used with a conventional ejector, the high pressure housing surrounds the conventional ejector with a pressurized fluid so that pressure drop, during operation, across the walls of the conventional ejector is reduced allowing a low pressure rated ejector to be used in a high pressure application. With adjustable or non-adjustable ejectors the pressure rating is increased by surrounding the ejector within a high pressure rated housing and by providing openings in the ejector to equalize pressure between the inside of the ejector and the cavities formed between the ejector and the exterior high pressure housing.

The present invention also provides a method for using an ejector having adjustable motive inlet nozzle and/or a mixing section throat in a fluid pumping process. This method comprises controlling the fluid conditions or mass flow rates within the ejector responsive to one or more fluid conditions in the process. The fluid conditions in at least one location of the fluid process are measured to allow a meaningful control.

For a further understanding of the invention and further objects, features and advantages thereof, reference may now be had to the following description taken in conjunction with the accompanying drawings.

BRIEF DESCRIPTION OF THE DRAWINGS

FIG. 23 is a schematic drawing of a heating and cooling process that can use an ejector with motive inlet nozzle and mixing throat adjustment means.

DESCRIPTION OF PREFERRED EMBODIMENTS

Figure 1:
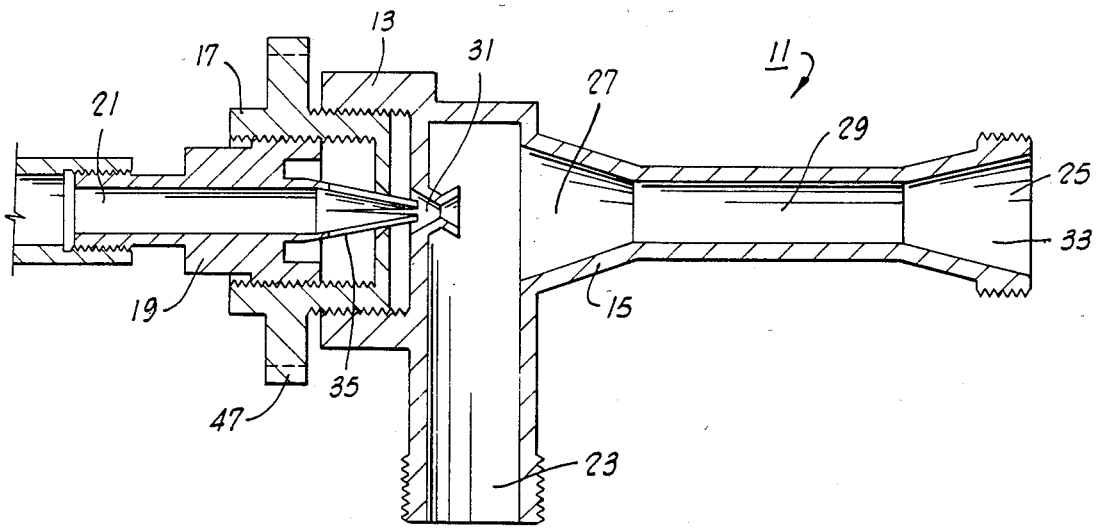
FIG. 1 is a side cross-sectional view of an ejector constructed in accordance with the present invention.

Referring to FIGS. 1 through 4, an ejector as constructed in accordance with the present invention is shown generally at 11. The ejector includes a housing 13 which defines the exterior of the ejector and most of its major parts. The housing 13 includes a single metal forward piece 15, a rotatable piece 17 and a fixed inlet assembly piece 19. Together each of these pieces form the ejector 11.

The ejector 11 has, like conventional ejectors, a motive inlet 21, a suction inlet 23, and an outlet 25. Fluid from the motive inlet and suction inlet are conveyed to and mixed in a mixing section 27. The mixing section 27 includes a mixing throat 29.

Except for the movable and adjustable parts of the present invention described below, the ejector of the present invention operates in a conventional manner. Motive fluid enters the ejector through motive inlet 21 and passes through a fixed nozzle 31. This rapidly moving motive fluid then passes into the mixing section 27 and the mixing throat 29. It entrains fluid from the suction inlet 23 thereby pumping the fluid from the suction inlet 23. The pressure of the mixed fluid which exits the mixing throat 29 can be increased by passing the fluid through a diffuser 33 before the fluid exits the ejector through outlet 25. Standard threaded connections are provided to connect the ejector to appropriate conduits.

In the embodiment shown in FIGS. 1 through 4, means are provided to vary the fluid presentation size of the inlet nozzle throat. As used herein, fluid presentation size means the size of the conduit as it effects the fluid conditions passing therebetween. In a fixed ejector this fluid presentation size would normally be the diameter of the particular conduit and its axial shape. For example, an inlet nozzle would have a fluid presentation size determined by the narrowest diameter or throat of the nozzle. In an adjustable ejector the cross section of the inlet nozzle throat or mixing section throat may not be perfectly circular and continuous, but rather discontinuous and eliptical such as when splined nozzle or mixing section parts are used for adjustments. Reference to this fact will sometimes be made by interchanging the term "fluid presentation size" with diameter or even area of nozzle throats and mixing section throats. When the term "throat diameter" or "fluid presentation size" is used, it is intended that either term can refer to both circular and noncircular cross sections having equivalent hydraulic diameters.

To allow adjustability of the inlet nozzle of the ejector of the present invention, the rotatable piece 17 is sealingly and threadedly connected to the inlet assembly piece 19 and the front piece 15. If desired, rubber seals or mechanical seals or the like can be provided to help seal against fluid loss at this rotatable threaded connection.

Extending from the front of inlet assembly piece 19 is a splined conical shaped conduit 35. This conduit has three splines 37, 39 and 41 which define the outlet and narrowed end of the conduit 35. These splines 37, 39 and 41 move together and apart to vary the taper of the conical shaped conduit 35 and the size of the outlet 49 of conduit 35.

The outlet 49 of conduit 35 extends into nozzle 31 such that fluid passing into and through nozzle 31 is received by and passes through conduit 35. The diameters of the nozzle 31 and the splined outlet of conduit 35 are designed so that varying the amount of closure of splines 37, 39 and 41 varies the fluid presentation size for fluid passing throuqh the motive end of the ejector. When splines 37, 39 and 41 are in their fully open position, the fluid flow conditions are dependent upon the fluid presentation size of nozzle 31. To ensure this, the diameter of nozzle 31 is normally chosen to be as large as the largest dimension of the non-circular cross section at the outlet of conduit 35 when the splines 37, 39 and 41 on conduit 35 are fully open. However, when splines 37, 39 and 41 are closed or partially open the fluid flow conditions are dependent upon the fluid presentation size of conduit 35.

As shown in FIGS. 1 through 4, the splines 37, 39 and 41 are opened and closed by rotation of rotatable piece 17. This is achieved because the front end of rotatable piece 17 is a guide member 43 through which the splines 37, 39 and 41 extend. A cylindrical opening 45 in guide member 43 wears upon the conical shaped exterior of conduit 35 and, when axially moved with respect to conduit 35, opens and closes splines 37, 39 and 41.

In order to rotate the rotatable piece 17, gear teeth 47 are provided on an exterior portion of piece 17. A mating gear and motor or other turning means can be provided to rotate the piece 17 with respect to inlet assembly piece 19 and front piece 15. Of course, inlet assembly piece 19 and front piece 15 remain fixed. As can be seen, rotation of the rotatable piece 17 producing a rearward motion of this piece opens the splines 37, 39 and 41. Forward motion of the rotatable piece 17 closes the splines 37, 39 and 41.

Figure 2:
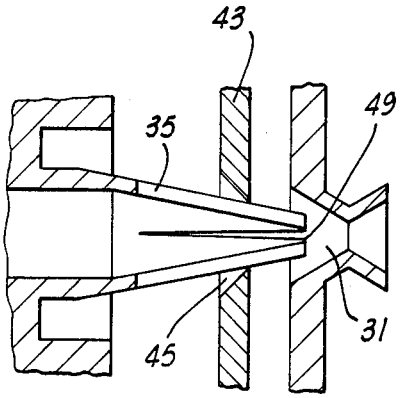
FIG. 2 is a side cross-sectional view of a portion of the ejector shown in FIG. 1.
Figure 5:
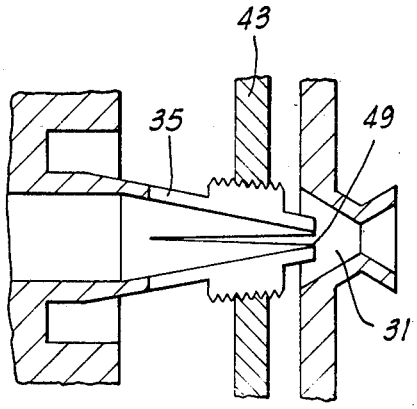
FIG. 5 is a side cross-sectional view of an alternate embodiment of the elements shown in FIG. 2.
Figure 3:
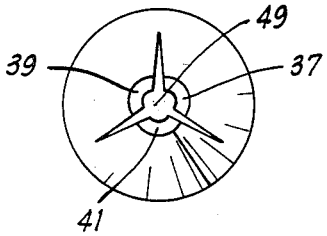
FIG. 3 is a front view of the splined conical conduit shown in FIGS. 1 and 2.
Figure 4:
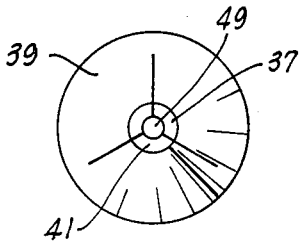
FIG. 4 is a front view of the splined conical conduit of FIG. 3 shown in a closed position.

As shown in FIG. 5, an alternate embodiment of the elements shown in FIG. 2 is illustrated. In this embodiment, the splines of conduit 35 are threaded on their exterior and the guide member 43 has mating threads so that the two are threadably connected. The threads are tapered so that movement of the guide member 43 along the threaded connection of the splines opens and closes the splines.

Figure 6:
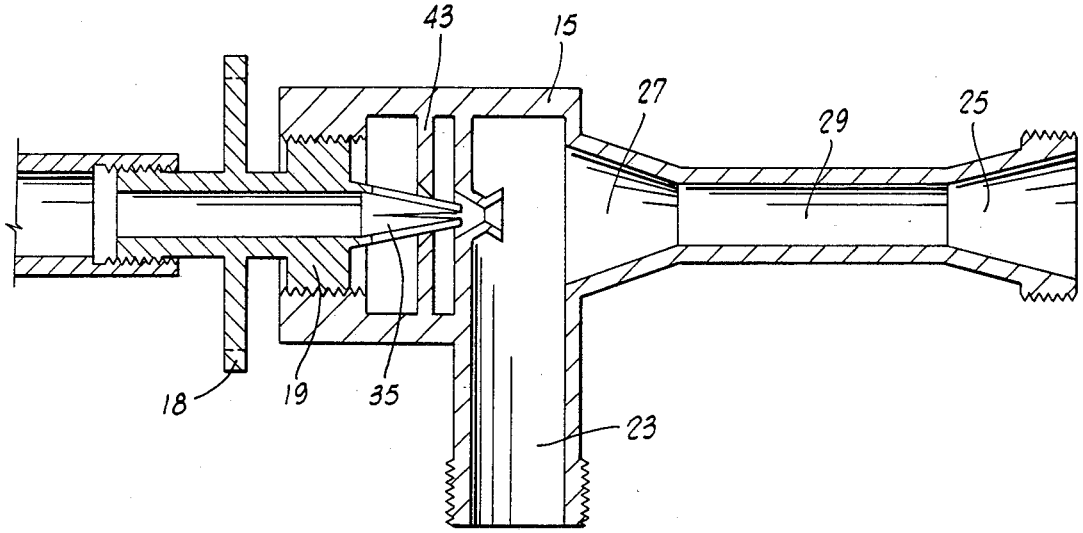
FIG. 6 is a side cross-sectional view of an alternate embodiment of an ejector constructed in accordance with the present invention.

Referring now to FIG. 6, an alternate embodiment of the present invention is shown. In this embodiment, the guide member 43 is formed as an integral portion of the front piece 15. The inlet assembly piece 19 is sealingly and rotatably connected to the front piece 15 such that rotation of the inlet assembly piece 19 moves the splined conduit 35 axially with respect to guide member 43. Otherwise, the function of the parts is the same as in the embodiment shown in FIGS. 1 through 4.

Figure 7:
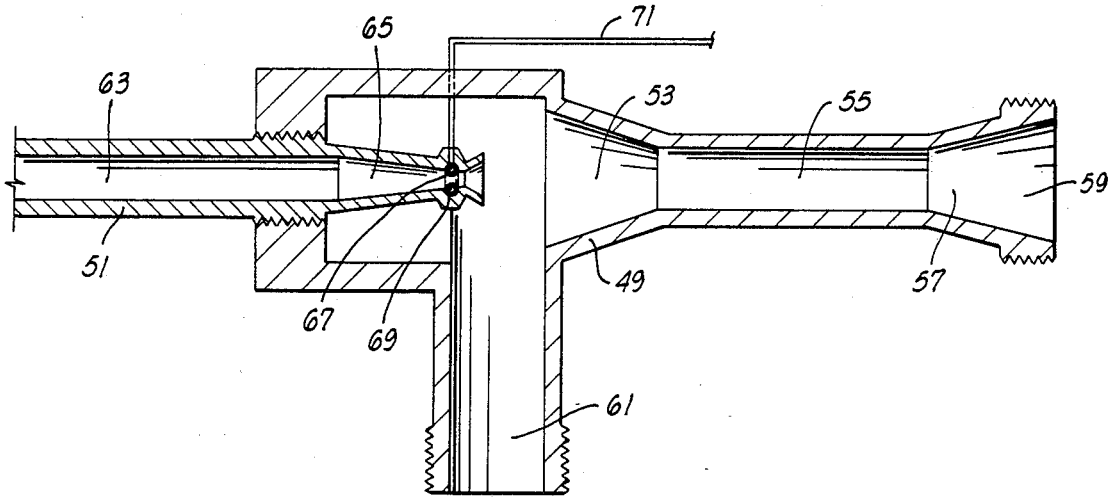
FIG. 7 is a side cross-sectional view of an alternate embodiment of an ejector constructed in accordance with the present invention.
Figure 8:
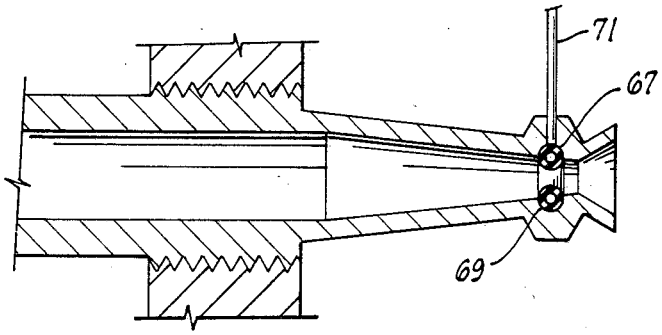
FIG. 8 is a side cross-sectional view of a portion of the ejector shown in FIG. 7.

Referring now to FIGS. 7 and 8, still another embodiment of the present invention is shown. In this embodiment there are no rotatable pieces and no seals are required to prevent leakage around ejector parts. The front piece 49, although threadably connected to the inlet assembly piece 51, does not rotate with respect thereto. As with the embodiment shown in FIG. 1, the front piece 49 includes a mixing section, a mixing throat 55, a diffuser 57, an outlet 59 and a suction inlet 61. The inlet assembly 51 includes a motive inlet 63 and a conical shaped nozzle conduit 65. The nozzle conduit 65 is the only inlet nozzle in this embodiment. Near the end of nozzle conduit 65 is a cylindrical groove 67. Fitted within groove 67 is an inflatable resilient torus 69. The torus 69 contains hydraulic fluid and can be inflated and deflated by passing hydraulic fluid to and from the torus by a conduit 71.

The hydraulic fluid conduit 71 extends through an opening in nozzle conduit 65 adjacent groove 67 and through front piece 49 to the exterior of the ejector. In this manner, a pressurized hydraulic fluid source can be utilized to inflate and deflate the torus 69 from the exterior of the ejector. The hydraulic source could either be a pump, a tap line from the conduit connected to the ejector motive inlet, or some other source with a pressure and flow control.

As can be seen, the torus 69 can extend into the fluid path through nozzle conduit 65. Thus, by inflating and deflating the torus 69 the fluid presentation size of the inlet nozzle can be altered.

Figure 9:
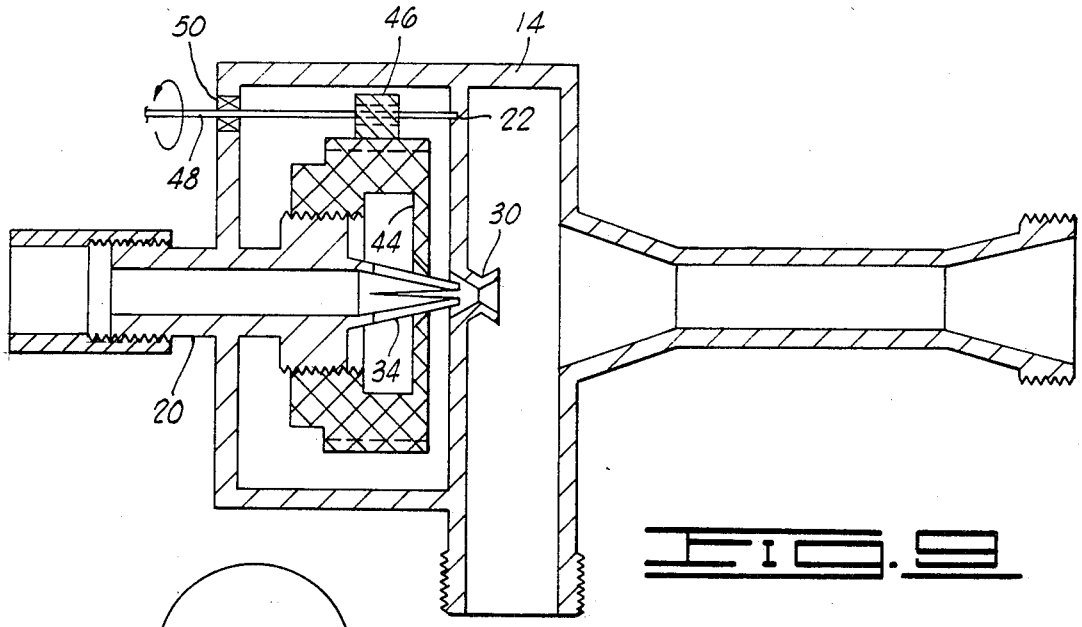
FIG. 9 is a side cross-sectional view of an ejector having gear driven parts for moving an adjustable, splined motive inlet nozzle.
Figure 16:
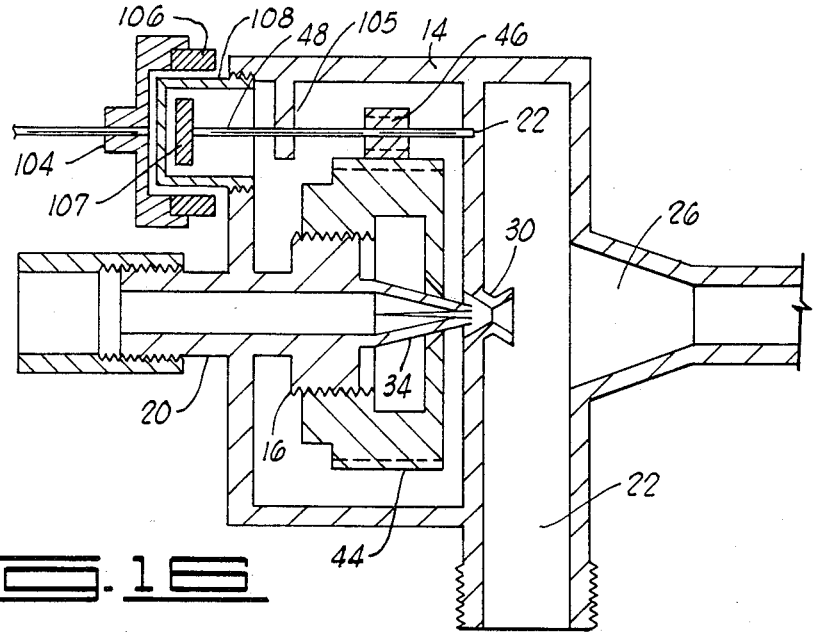
FIG. 16 is a side cross-sectional view of a portion of an ejector having adjustable motive inlet nozzle parts and a magnetic coupling to drive the adjustable nozzle parts.

FIGS. 9 and 16 show other embodiments of ejectors with an adjustable nozzle throat diameter. While these embodiments are similar to the embodiment of FIG. 1, they have fewer rotating joints which require seals for high pressure applications. A rotatable guide member 44 moves tapered outlet splines 34 on the motive inlet conduit 20 between open and closed positions. This movement of the splines 34 in combination with fixed nozzle 30 results in changes in the effective nozzle throat size previously described for the embodiments of FIGS. 1 and 6. Guide member 44 rotates on a threaded rim 16 which is part of motive inlet conduit 20. Shaft 48 drives gear 46 which meshes with gear teeth (shown by dashed lines) on guide member 44 thereby causing movement of member 44 with respect to the fixed motive inlet conduit 20. In FIG. 9, shaft 48 is supported at the ejector internal piece 22 and at shaft seal 50. The shaft seal 50 can be a mechanical seal for high pressure applications. The embodiment shown in FIG. 9 therefore has only one rotating seal and is less likely to have leakage problems. In FIG. 16, drive shaft 48 is supported at the ejector internal pieces 22 and 105. In this embodiment, a magnetic coupling is used to eliminate the need for rotating seals and further reduce the possibility of leakage. A magnet disk 107 on the end of shaft 48 is driven by a magnetic torus 106 mounted on drive shaft 109. Magnet cup 108 can be threaded, welded or statically sealed to ejector housing 14. 316 Stainless steel is often chosen for the magnet cup to provide strength for pressure containment and the magnetic properties needed so that magnets 106 and 107 can be effectively coupled. This magnetic coupling design has been previously used on a variety of gear pumps such as those made by Micropump TM and the Tuthill Corporation.

Figure 10:
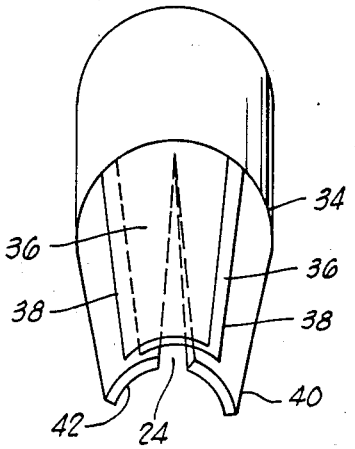
FIG. 10 is an overhead, front view of a portion of a splined motive inlet nozzle having sealing flaps covering the openings between the nozzle splines.
Figure 11:
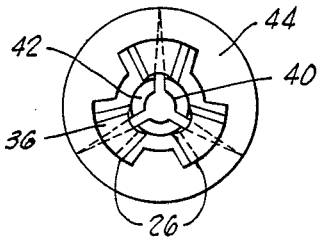
FIG. 11 is a front view of portions of a splined motive inlet nozzle with sealing flaps and a notched nozzle spline guide member.
Figure 19:
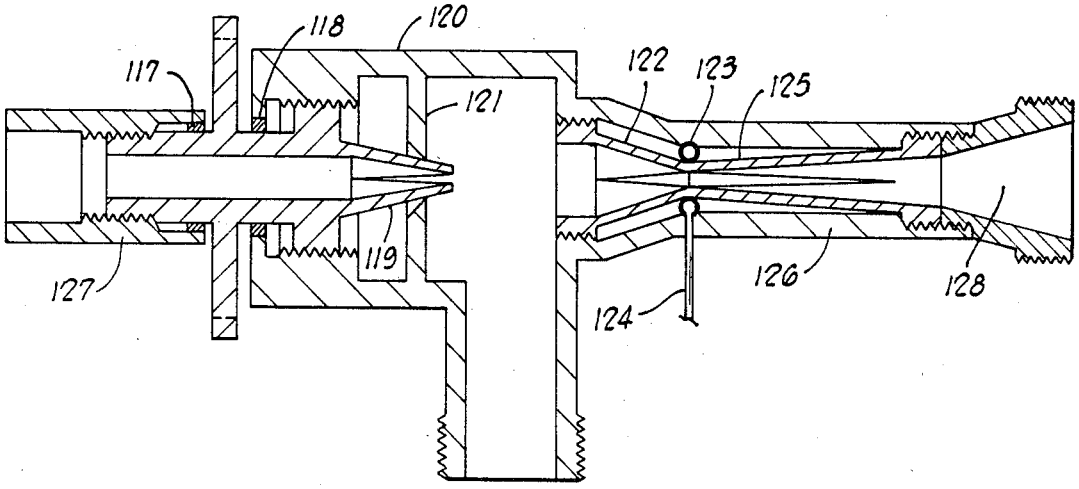
FIG. 19 is a side cross-sectional view of an ejector having an adjustable motive inlet nozzle conduit and mixing throat and seals along the rotatable motive inlet nozzle conduit.

FIG. 10 is a head on view of part of the tapered and splined motive nozzle outlet 34 for the ejector in FIG. 9. Two of the splines 40 and 42 for the nozzle 34 are shown. Parts 36 are two thin walled overlapping flaps attached to splines 40 and 42 along seams 38, preferably by tack welds if the flaps 36 are metal or by Epoxy if the flaps 36 are plastic. One set of two flaps is used to cover each opening 24 between adjacent splines. The flaps overlap and each flap is attached to only one of the splines so that as the splines move together or apart, the flaps are free to move across each other while still covering the opening 24 between the splines. The flaps 36 reduce leakage and pressure losses through spline opening 24 and increase ejector efficiency when the nozzle outlet splines 42 and 40 are not closed together. When these flaps are used the extra outlet nozzle 30 shown in FIG. 9 is not needed. Even without flaps 36 on nozzle conduit 34, the outlet nozzle 30 is not required, but is preferred for better ejector performance and efficiency. FIG. 19 shows an ejector with a splined outlet nozzle conduit 119 but without the extra outlet nozzle 30 of FIG. 9. When flaps 36 are used on nozzle conduit 34, notches 26 shown in FIG. 11 can be cut in the circular opening of guide member 44 so that the guide member 44 can ride on the splines 40 and 42 without contacting flaps 36 as the guide member 44 moves relative to nozzle conduit 34. Of course, the width of flaps 36 is chosen to be small enough so the flaps 36 will not contact the guide member notches 26. The flaps can be attached to splined ejector nozzles used in other adjustable nozzle configurations such as shown in FIGS. 1 and 6 and the guide members used in these configurations can be modified as in FIG. 11 to accommodate the flaps.

Referring now to FIGS. 12 13 14 and 15, embodiments of the present invention which vary the mixing throat fluid presentation size are shown. In these embodiments there is a single piece ejector housing 73 which includes the motive inlet 75, the suction inlet 77, the mixing section 79, the mixing throat 81, the outlet diffuser 83 and the outlet 85.

Figure 12:
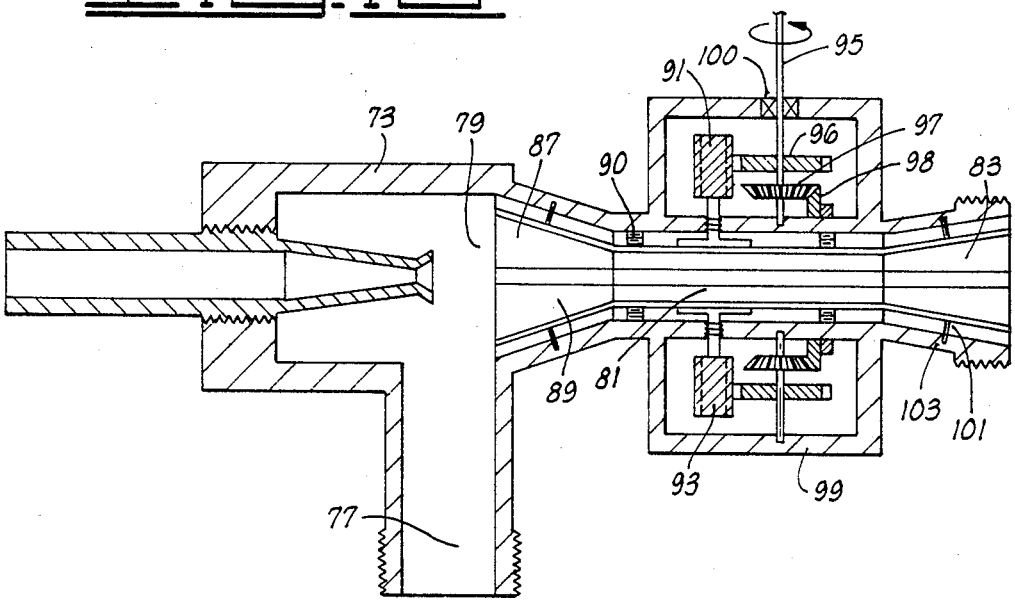
FIG. 12 is a side cross-sectional view of an ejector having gear driven parts for moving an adjustable, segmented mixing section.
Figure 13:
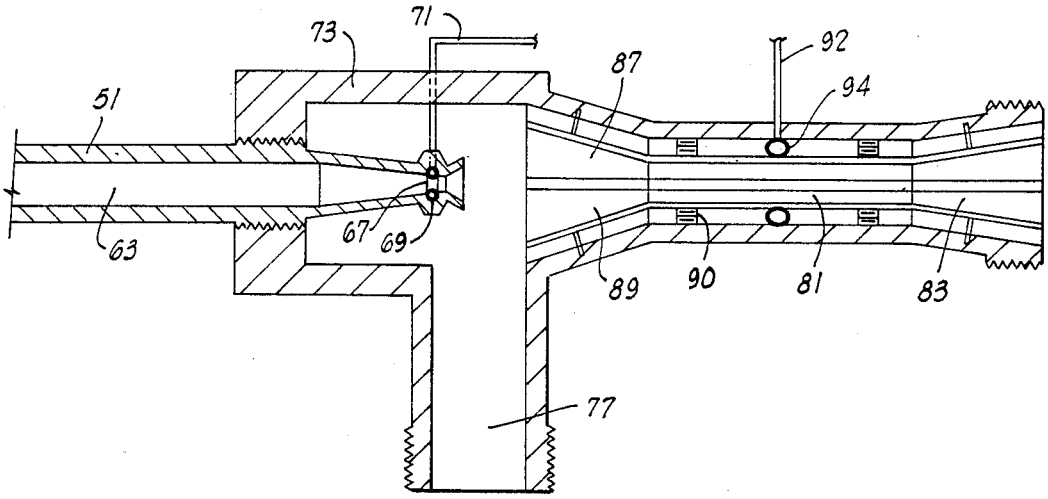
FIG. 13 is a side cross-sectional view of an ejector having an inflatable torus surrounding an adjustable, segmented mixing section.
Figure 14:
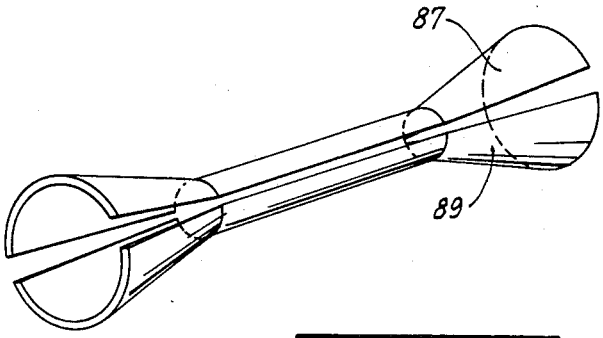
FIG. 14 is an outside side view of a segmented ejector mixing section with convergent, mixing throat and divergent, diffuser portions.

In both of the embodiments shown in FIGS. 12 and 13, the segmented throat elements 87 and 89 of FIG. 14 are utilized. These throat elements 87 and 89 extend along the interior of the mixing throat 81 from the mixing section 79 to the outlet 85. Thus, as shown, the throat segments 87 and 89 define an inner mixing section and outlet diffuser.

The throat segments 87 and 89 are movable with respect to each other. The fluid presentation size of the mixing throat 81 and diffuser can be varied by moving the two segments toward and away from each other. Flanges 101 on the exterior of segments 87 and 89 fit into grooves 103 on the interior of housing 73 to maintain the positioning of segments 87 and 89 and to limit leakage flow and pressure losses between the longitudinal openings between segments 87 and 89.

As shown in FIG. 12, mechanical, gear driven screws 91 and 93 are threaded through the walls of housing 73 to abutt the interior of throat segments 87 and 89. Rotation of gear elements 95, 96, 97 and 98 disposed within a gear box 99 will rotate screws 91 and 93 and move segments 87 and 89 toward and away from each other.

A hydraulic torus 94 is used inside the ejector mixing section shown in FIG. 13 to move segments 87 and 89 toward and away from each other. Hydraulic fluid in conduit 92 is used to inflate or deflate the torus 94. Grooves can be put in ejector housing 73 to seat and hold torus 94 in a fixed position.

To provide additional assurance that segments 87 and 89 stay in contact with torus 94 or with screws 91 and 93, springs 90 can be attached to both the ejector housing 73 and segments 87 and 89. Also, pads (shown in FIG. 12) can be attached to the end of screws 91 and 93 in a ball and socket, swivel type joint (not shown) such that screws 91 and 93 can rotate inside the joints without rotating the pads as the screws 91 and 93 can in turn be attached to segments 87 and 89 so that the segments 87 and 89 stay in contact with the pads as screws 87 and 89 are rotated.

In FIG. 14 mixing section segments 87 and 89 are shown with a convergent portion, a throat portion and a divergent, diffuser portion. The convergent and divergent portions can also be eliminated or the taper on these portions can be increased or reduced. The taper on these portions will have some slight effect on ejector overall efficiency. It is also possible to construct an improved mixing section configuration (not shown) that looks like the one shown in FIG. 14 but is splined and is in one piece rather than having two or more segments. This configuration could be achieved by attaching (welding, gluing) the two halves of a cylinder (split along the longitudinal cylinder axis) to the ends of splines at the smaller diameter ends of two splined nozzles. The nozzle splines in this case do not extend to the larger diameter of the nozzle, i.e. the nozzle is not completely split. Another method of fabricating this configuration would be to cut longitudinal slots into a solid, continuous piece shaped like the piece in FIG. 14, but with the slots not extending all the way to the ends of the converging and diverging sections. The center, straight cylindrical section could also be eliminated as in FIG. 19. This alternate configuration would have its splined openings moved together or apart by the same means shown in FIGS. 12 and 13.

Figure 15:
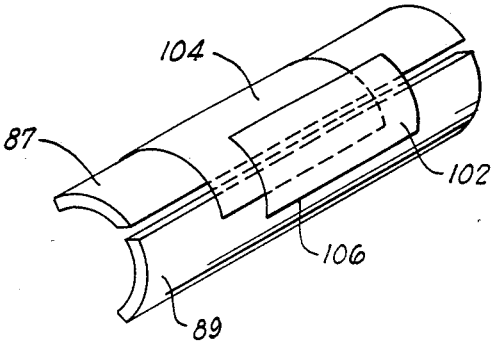
FIG. 15 is an outside side view of a portion of a segmented ejector mixing section with sealing flaps covering openings between segments.

Sealing flaps 102 and 104 are shown in FIG. 15 for covering the openings between segments 87 and 89 for the mixing section of FIG. 14. Flaps 102 and 104 limit leakage and pressure loss through the openings between segments 87 and 89. They act similarly to sealing flaps 36 shown for nozzle 34 in FIG. 10. Flaps 102 and 104 overlap and each flap is attached along the flap length to only one of the segments, say to segment 89 along seam 106, so that as the segments 87 and 89 move together or apart, the flaps 102 and 104 are free to move across each other while still covering the opening between the segments 87 and 89. Of course, a similar arrangement of flaps can be used to also cover the openings between the converging and diverging portions of the mixing section in FIG. 15. Furthermore, flaps can be used to cover the slots in the alternate one piece mixing section configuration previously described. It is desirable that the flaps not be present at the points where the gear driven screws 91 and 93 or inflatable torus 94 of FIGS. 12 and 13 respectively contact the mixing sections.

Figure 17:
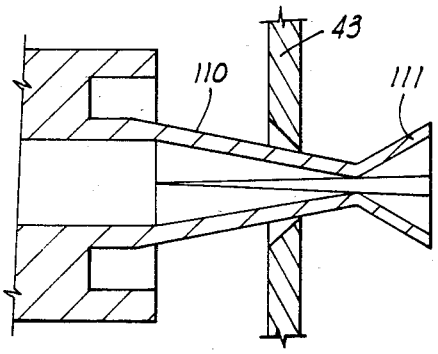
FIG. 17 is a side cross-sectional view of a splined diffuser section connected to a convergent and splined motive inlet nozzle.
Figure 18:
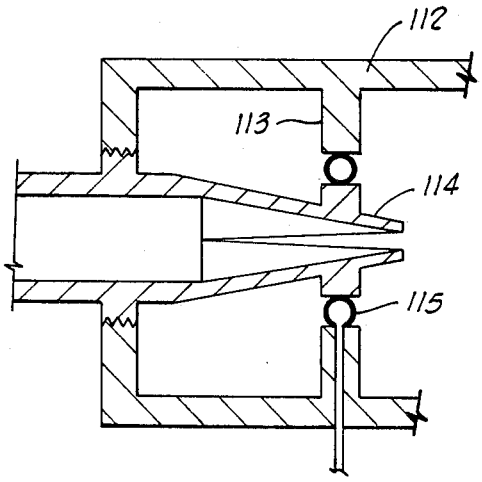
FIG. 18 is a side cross-sectional view of a portion of an ejector having an inflatable torus surrounding a splined motive inlet nozzle.

FIGS. 17, 18 and 19 show variations on the adjustment features previously discussed for ejectors. In FIG. 17 a splined diverging or diffuser section 111 can be added to a splined motive inlet nozzle 110. The splined diffuser section 111 opens and closes with the nozzle 110 when guide member 43 rides along the nozzle 110. The feature in FIG. 17 can be used when a diffuser section is wanted on the inlet motive nozzle, and when an extra fixed motive nozzle with a convergent section (such as part 30 in FIG. 9) is not used. Flaps can be attached to cover the openings between both the splined nozzle 110 and convergent section 111 as was shown in FIG. 10.

FIGS. 7 and 8 show the use of an inflatable torus 69 on the inside of a solid motive nozzle 65 (without splines) for adjusting the throat size of the nozzle 65. FIG. 18 also shows that the fluid presentation size of a motive nozzle 114 can be adjusted by using an inflatable torus 115 on the outside of nozzle 114 when the nozzle 114 is splined. The inflatable torus 115 is supplied by hydraulic fluid from hydraulic line 116. Ejector structure member 113 which is part of ejector wall 112 supports the inflatable torus 115 and acts as a support guide for hydraulic line 116. When the torus 115 is inflated, an inward force is directed on the shoulder of nozzle 114 to reduce the fluid presentation size of nozzle 114. This results because support member 113 is not free to move while the splines on nozzle 114 are free to move. Nozzle 114 can have a splined convergent section added to its end if desired as shown in FIG. 17. Also, sealing flaps can be added to nozzle 114 as shown in FIG. 10.

The ejector in FIG. 19 has parts for adjusting the fluid presentation size of both the splined motive inlet nozzle 119 and the splined mixing section nozzles 122 and 125. When the motive nozzle 119 is rotated, contact with fixed guide member 121 results in opening or closing of the splined nozzle 119 outlet. FIG. 19 also shows two seals 117 and 118 that are between the rotatable nozzle 119 and the motive inlet conduit 127 and ejector housing 118, respectively. Seal configurations like these could also be used at rotating joints present on the adjustable ejectors shown in FIGS. 1 and 6. Note also that this ejector does not have an extra inlet nozzle like nozzle 31 in FIG. 36 to shield against pressure losses or leakage through the nozzle splines on nozzle 119. The fluid presentation size of the motive inlet nozzle 119 can still be controlled without the extra nozzle, but ejector efficiency will be less. Of course, either sealing flaps like flaps 36 in FIG. 10 or an extra nozzle could be provided to improve the ejector efficiency. Also, a splined convergent section can be added to the end of nozzle 119 as shown in FIG. 17 with or without sealing flaps. The mixing section housing 26 of the ejector has two splined nozzles 122 and 125 which may or may not be connected at the inflatable torus 123. The nozzles 122 and 125 open and close together when torus 123 is deflated and inflated by hydraulic fluid in hydraulic line 124. Torus 123 makes contact with both nozzles 122 and 125 and with the ejector housing 126. Grooves can be made in mixing section housing 126 and at the outlet of nozzles 122 and 125 to seat torus 123. Notice that the nozzles 123 and 125 and diffuser piece 128 can both be threaded into housing 126 for easy fabrication and maintenance. Nozzle sealing flaps like flaps 36 in FIG. 10 can also be attached to nozzles 122 and 125 to cover openings between splines on these nozzles and thereby reduce pressure losses and increase ejector efficiency. The mixing section fluid presentation size adjustment configuration of FIG. 19 can be used in place of the adjustment configurations shown in FIGS. 12 and 13. Also, the splined convergent and divergent nozzles 122 and 125 could also be combined into one splined nozzle with convergent and divergent sections.

Many ejectors are made from thin waled, low strength castings to save material and machining costs. Depending on operating temperatures, many cast ejectors are rated for no more than 200 psi. of pressure at the motive inlet for reducing pressures below atmospheric at the suction inlet. Increasing the pressure rating usually requires either thicker walled castings or higher strength forgings with extensive machining and greater labor costs.

It has been found with this invention that the pressure rating of cast or other low pressure rated ejectors can be greatly increased without having to replace the ejector internal parts with more costly, higher strength parts. The pressure rating of an ejector can be increased by sealing the ejector in a pipe or vessel having a pressure rating higher than that of the ejector. Many of the embodiments shown before, such as in FIGs. 9 and 12, for adjusting inlet nozzle and mixing throat size have sealed housings surrounding at least part of the ejector to reduce leakage. By using high pressure rated housings and extending them to surround most of the ejector, the complementary results of both increasing the pressure rating of the ejector and providing a seal for the nozzle inlet and/or mixing throat adjusting parts is achieved. Also, even when inlet nozzle and mixing throat adjustment features are not on the ejector, the ejector operating pressure can be increased by surrounding and sealing the ejector in a higher rated pressure housing. Consider the following cases to show the increase in operating pressure capabilities for an ejector rated for a motive inlet pressure of 200 psi and temperatures less than 500° F. These conditions apply for cases I and II: Motive inlet fluid pressure 1000 psi, suction pressure 200 psi; discharge pressure between 200 and 400 psi; nozzle and nozzle inlet conduit rated for 1000 psi.

CASE I: Outside of ejector subject to pressure between suction and motive pressure, say 400 psi. Inside of ejector subject to between 200 and 400 psi. The differential pressure across the ejector structure is no more than 200 psi, the ejector's rated pressure. The pressure conditions for Case I will occur for a housed ejector with a configuration like that shown in FIG. 20 where the cavity between the ejector and ejector housing is open to the splined motive nozzle. The pressure in the cavity will be between the pressure at the outlet of the nozzle, close to the suction pressure, and the pressure at the openings between the nozzle splines, which is less than the motive inlet pressure.

Of course, the housing around the ejector and the joints between the housing and ejector must be rated at 1000 psi. But since the housing can have a simple cylindrical shape like that of a pipe or a pressure vessel, few stress concentrations will be present and a low cost, easily fabricated housing can be obtained for the rated pressure of 1000 psi.

CASE II: Outside of ejector subject to between suction and discharge pressure, say 300 psi. Inside of ejector subject to between 200 and 400 psi. The differential pressure across the ejector structure is no more than 100 psi, less than the ejector rated pressure. Of course, the housing and housing connections must be rated for 1000 psi. The pressure conditions for Case II will occur for a housed ejector with a configuration like that shown in FIG. 21 where the cavity between the ejector and ejector housing is open to the mixing section. The pressure in the cavity will be between the suction pressure and the discharge pressure, depending on whether openings in the mixing section wall are made at the entrance to the mixing section or at the diffuser section or somewhere in between.

CASE III: (Conditions - Motive inlet fluid pressure, 1000 psi suction pressure, 800 psi; and discharge pressure between 800 and 1000 psi.) Outside of ejector subject to pressure between suction and motive pressure, say 900 psi. Inside of ejector subject to between 800 and 1000 psi. The differential pressure across the ejector structure is no more than 100 psi. But for some parts of the ejector structure this differential pressure results in compressive stresses, while in other parts the stresses will be tensile. In this case the motive nozzle needs to be rated only for at least 200 psi; while the inlet conduit must still be rated at 1000 psi. The pressure conditions for Case III will occur for an ejector configuration like that shown in FIG. 20.

Figure 20:
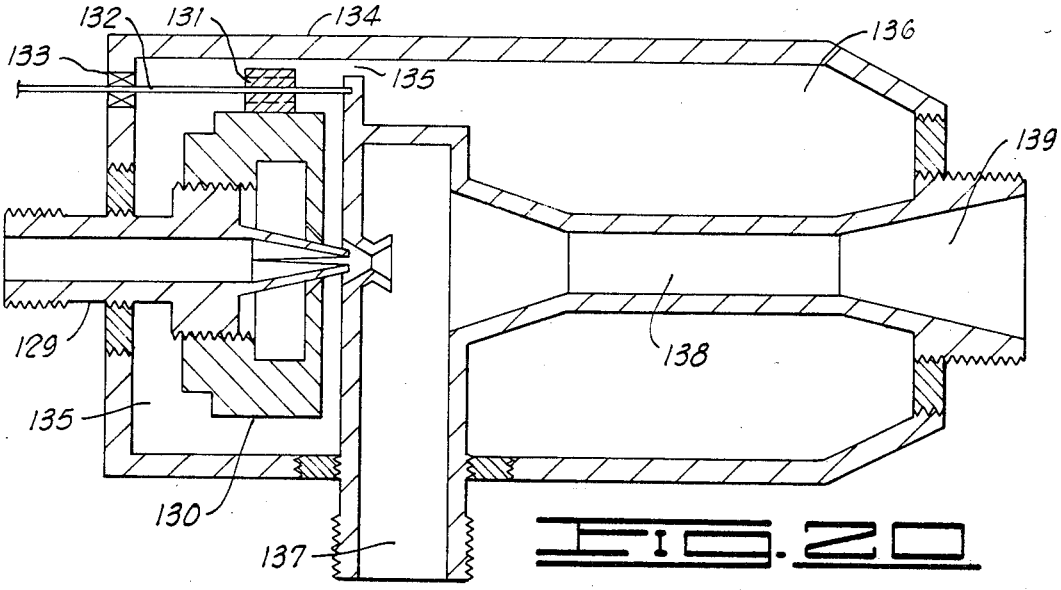
FIG. 20 is a side cross-sectional view of an ejector having an adjustable motive inlet nozzle and a high pressure rated outer housing.

FIG. 20 shows an ejector like that shown in FIG. 9 with nozzle throat adjustment parts 130, 131, and 132 surrounded by a high pressure housing 134 connected by threads at the motive inlet conduit 129, at the suction inlet 137, and the ejector outlet 139. These connections of course could also be seal welded. A mechanical seal 133 is provided in housing 134 to provide a seal around drive shaft 132 used to rotate drive gear 131 and move guide member 130. Note that the cavity 135 around the inlet conduit 129 is in fluid communication with the cavity 136 around the ejector mixing section 138 by means of an opening 135 provided between the two cavities 135 and 136. Cavity 136 will be exposed to the pressure of the outlet of the motive inlet conduit 129 because the outlet of the conduit 129 is in fluid communication with cavity 135 and thereby with cavity 136 by means of opening 135.

Figure 21:
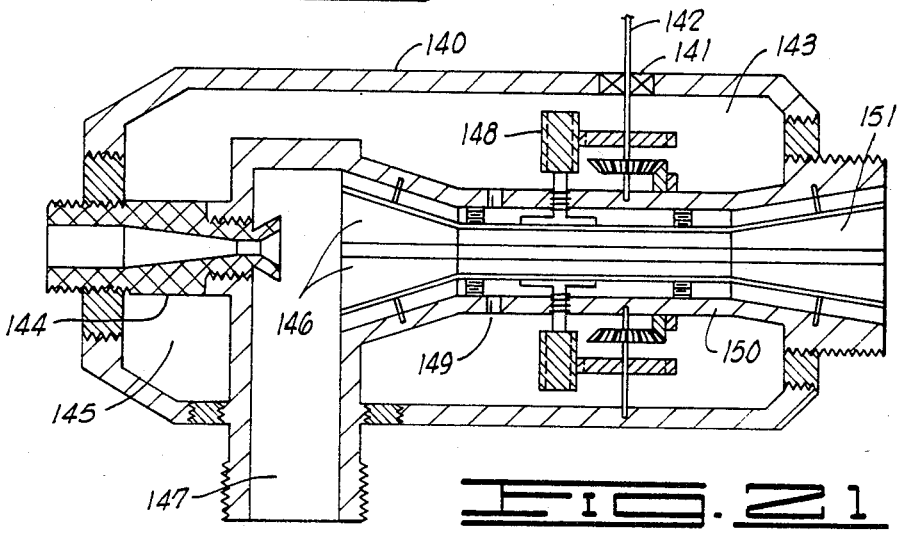
FIG. 21 is a side cross-sectional view of an ejector having an adjustable mixing throat and a high pressure rated outer housing.

FIG. 21 shows an ejector like that shown in FIG. 12 with mixing throat adjustment parts 148 surrounded by a high pressure housing 140 that is connected to the ejector by threads (and seal welded if needed) at the motive inlet conduit 144, at the suction inlet 147 and the ejector outlet 151. A mechanical seal 141 is provided in housing 140 to provide a seal around drive shaft 142 used to rotate mixing throat adjustment parts 148 and move mixing throat segments 146. Cavity 145 around the inlet conduit 145 is open to and in fluid communication with cavity 143 around the mixing section 150. Cavities 143 and 145 are exposed to the pressure in mixing section 150 by means of leakage between adjustment parts 148 and the mixing section wall 150. If better fluid communication and pressure equalization is desired between the cavities 143 and 145 and mixing section 150, then holes 149 can be put in the mixing section 150 wall.

Figure 22:
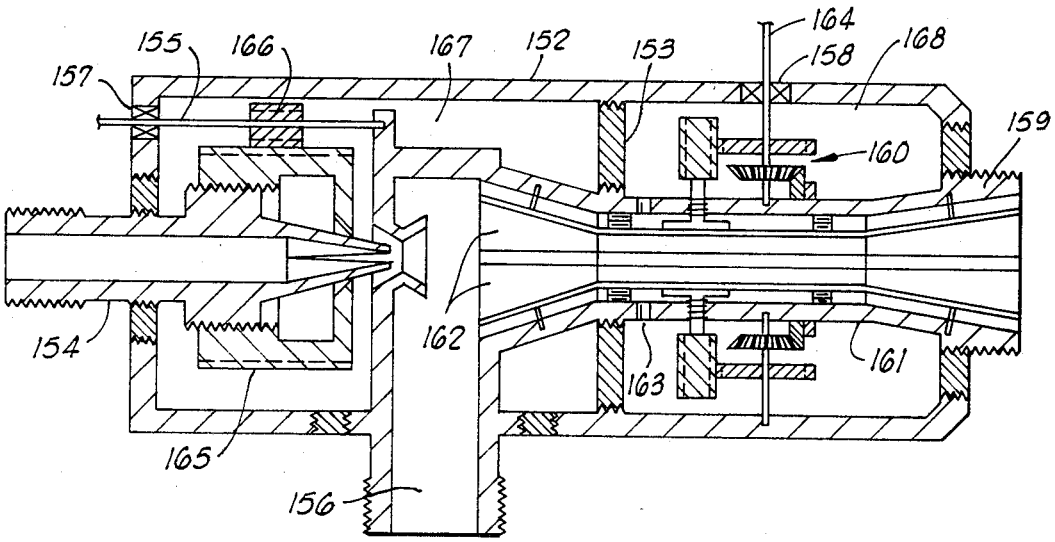
FIG. 22 is a side cross-sectional view of an ejector having adjustable motive inlet nozzle and mixing throats, and high pressure rated outer housings.
Figure 3:
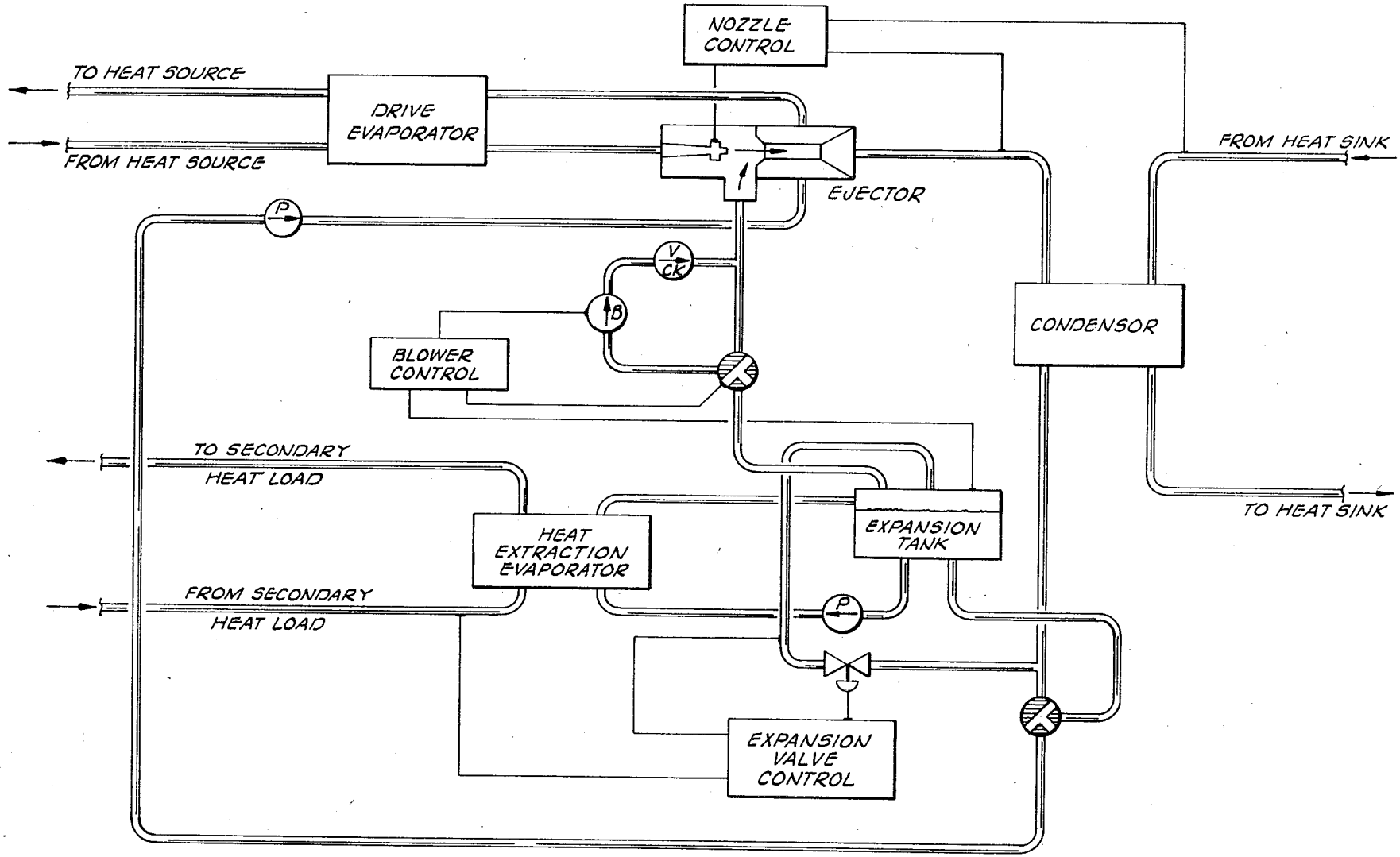

A higher pressure rated ejector can also be achieved even when adjustment means are provided for both motive nozzle and mixing throat diameters. FIG. 22 shows an ejector combining the adjustment features of ejectors shown in FIGS. 9 and 12 surrounded by a high pressure rated housing 152 which is connected by threads (and seal welded if needed) at the motive inlet conduit 154, at the suction inlet 156, and at the ejector outlet 159. A rigid pressure containment torus 153 is threaded into the housing 153 and mixing section wall 161, and the torus 153 can be seal welded if necessary at these connections. The containment torus 153 is provided to assure that there is no leakage flow or loss of pressure between the inlet nozzle adjustment cavity 167 and mixing throat cavity 168. Cavity 167 is exposed to the pressure at the outlet of motive inlet conduit 154. Cavity 168 is exposed to the pressure in mixing section 161 by means of leakage between mixing throat adjustment parts 160 and the mixing section wall 161. For better pressure equalization between fluid inside mixing section 161 and fluid inside cavity 168, holes 163 can be added in the mixing section wall 161. Mechanical seals 157 and 158 are in the housing 152 for sealing around shafts 155 and 164 used to move inlet nozzle adjustment parts 165 and 166 and to move mixing throat adjustment parts 160.

Even if adjustment means for inlet nozzle or mixing throat means are not used, a high pressure rated housing can still be connected to the ejector motive inlet, suction inlet, and discharge outlet to surround the ejector and increase the operating pressure capability of the ejector. The cavities around the motive inlet nozzle and mixing throat section could be in fluid communication with each other. If so, one of these cavities should also be in fluid communication with either the motive inlet, the discharge, or the suction sections, but not more than one of these sections. Alternatively, the two cavities could be sealed off from each other as shown in FIG. 22, by a rigid containment torus between the cavities. In this case each cavity would be in fluid communication with only one of the motive inlet, discharge and suction sections. As shown in FIGS. 20, 21 and 22, fluid communication between the cavities around the ejector and the ejector motive inlet, suction and discharge sections can be achieved by putting holes in the ejector walls forming these sections. This can be done even when no adjustment features are present on the ejector. Although it has not been shown, holes could be put in the motive inlet nozzle or, as shown, (see FIG. 20) two motive inlet nozzles, one within the other, could be used to provide fluid communication between the motive inlet and the cavities around the ejector nozzle and mixing throat section. Another possible embodiment would involve establishing on fluid pressure communication with the ejector housing cavity and the ejector suction section by putting holes in the ejector suction section walls. This embodiment is feasible when ejector operating conditions are such that the difference in the motive and suction pressures will be less than the structurally rated pressure of the ejector and such that the difference in the suction and ambient (external to ejector) are greater than the structurally rated pressure of the ejector.

When holes are used to communicate pressure between the inside of the ejector to the cavities between the ejector and ejector housing, the pressure rating for the housed ejector in general will be higher when the holes are located at points of lower pressure on the inlet nozzle; that is, close to the nozzle outlet, and at points of higher pressure in the discharge section; that is close to the diffuser. Locating the holes in this fashion will reduce the differential pressure across the ejector structure for fixed motive and suction pressures and will permit operating the housed ejector at even higher pressures. Of course, the ejector housing and housing to ejector connecting joints must still be rated for these higher pressures.

When starting up or shutting down a pressurized system with an ejector which has its pressure rating extended by a high pressure housing, it is of course necessary not to exceed the lower pressure rating of the ejector. One way to start up or shut down a low pressure rated ejector with a high pressure housing is to first change the pressure inside and outside the ejector (in the cavity between the ejector and the housing) together while maintaining the difference between inside and outside pressures to less than the rated pressure of the ejector. For start-up, the pressures would be increased up to near the expected maximum starting operational pressure, then the ejector discharge conduit would be opened simultaneously with or shortly before the ejector suction conduit is opened. For shut-down, the pressures would be lowered to near ambient conditions at one or more of the ejector openings, then the ejector suction line would be shut simultaneously with or shortly before the ejector discharge line is shut. To accomplish this start-up and shut-down procedure, valves in the ejector suction and discharge conduits will be required. The valve in the ejector suction conduit could be a two way valve having one position to permit only operating suction flow and another position to by-pass the suction conduit and permit only flow from a pressure source at near the same pressure of the motive inlet pressure. The difference in the motive pressure source and suction side pressurization source should be no greater than the pressure rating of the ejector.

The performance of an ejector is a function of the motive nozzle and mixing throat diameters, motive inlet pressure, suction and discharge pressures, and ratios of specific heats, molecular weights and temperatures of the fluids entering the ejector. FIGS. 6–68 on page 6–31 of Perry's Chemical Engineer's Handbook (Fourth Edition) shows optimum design curves for single stage ejector performance. Reference to these curves and equation 6–38 on page 6–30 of Perry's Handbook shows that the ejector performance can be mathematically described by the following functional relations F and G:

$$P_s/P_m = F\,(W_s/W_m,\ A_d/A_m,\ T_mM_s/M_mT_s,\ (C_p/C_v)_s/(C_p/C_v)_m) \quad (A)$$

$$P_s/P_m = G\,(A_d/A_m,\ P_d/P_s,\ T_mM_s/M_mT_s,\ (C_p/C_v)_s/(C_p/C_v)_m) \quad (B)$$

where $P_s$, $P_m$ and $P_d$ are suction, motive and discharge pressures, respectively; $A_d/A_m$ is the ratio of mixing throat area to motive nozzle outlet area; $(C_p/C_v)_s$ is the ratio of fluid heat capacities at constant pressure and constant volume at the ejector suction, $(C_p/C_v)_m$ is the ratio of fluid heat capacities at constant pressure and constant volume at the ejector motive inlet; $T_m$ and $T_s$ are fluid temperatures at the ejector motive and suction inlets; and $M_m$ and $M_s$ are fluid molecular weights at the ejector motive and suction inlets.

For most control applications the types of suction and motive fluids don't change during control operations with the ejector, so that ratios of heat capacities and molecular weights for the suction and motive fluids will be constant. Also in many applications, the motive fluid pressure and temperature are dependent on each other via an equation of state for constant composition and equilibrium conditions (no superheated or subcooled conditions). The suction fluid pressure and temperature are dependent under the same conditions as well. For the above cases therefore, the functional relation F is dependent on the six independent variables $P_s$, $P_m$, $A_d$, $A_m$, $W_s$, and $W_m$ and the functional relation G is dependent on the five independent variables $P_s$, $P_m$, $A_d$, $A_m$ and $P_d$. In other words, we have two equations for the functionals F and G relating the seven independent variables $P_s$, $P_m$, $P_d$, $A_m$, $A_d$, $W_s$ and $W_m$ which affect ejector performance.

Another independent equation applies to an ejector for single phase equilibrium flows. This equation can be derived by combining continuity and momentum equations for fluid passing through nozzles and orifices. When fluid enters at the motive pressure $P_m$ and exits at the suction pressure, it can be shown that the following relation holds for nozzles and orifices:

$$W_m = H(A_m,\ P_m,\ P_s).$$

Here $A_m$ is either the orifice area or nozzle throat area, which is variable. It is assumed that the inlet area for the nozzle is fixed. Verification of this relation can be found in several places such as equation 12–78 on page 357 of the book, Nuclear Heat Transport, by El-Wakil (1970), or equation 37 on page 692 of Part II of the book, Chemical Process Principles by Hougan, Watson and Ragatz (1959).

Now we have three independent equations for the functionals F, G and H relating the seven independent fluid condition variable unknowns. Therefore, when one of $A_d$ and $A_m$ is fixed by design, and a ratio of mass flow rate or a mass flow rate is to be controlled or constrained, there results two fewer unknowns giving a total of three independent equations for five independent variables. Now if two of the three pressure conditions, $P_m$, $P_s$ and $P_d$ are matched at the ejector openings, there are now only three unknowns, $A_m$ or $A_d$, $W_s$ or $W_m$ and one of $P_m$, $P_s$ and $P_d$, which can be solved for using the three equations for the functionals F, G and H. When both $A_d$ and $A_m$ are adjustable either two mass flow rates and two pressure conditions or one mass flow rate and all three pressure conditions can be satisfied by the three equations for F, G and H. If all three pressure conditions $P_m$, $P_s$ and $P_d$ are to be matched, when only one of $A_d$ or $A_m$ is adjustable, then the mass flow rates are uncontrollable. When one pressure condition cannot be fixed at one of the ejector openings, then pressure at that opening must be adjusted by the system containing the ejector. The unique and useful method of this invention therefore is matching up to four fluid conditions at the ejector openings by adjusting both ejector areas $A_m$ and $A_d$ and one other fluid condition at one of the ejector openings. If only one ejector area is adjustable, then up to three fluid conditions at the ejector openings can be matched in the same manner.

In a process application where an ejector with an adjustable motive nozzle and/or mixing throat is used, $A_m$ and/or $A_d$ can be automatically and continuously changed to control one or more of the mass flow rates at the ejector inlets and outlet (discharge) while matching at least some of the fluid pressure conditions at the same ejector inlets and outlet. If only one of $A_d$ and $A_m$ can be adjusted, then either the ratio of suction to motive mass flow rates or one of the suction and motive mass flow rates can be controlled. If both $A_d$ and $A_m$ can be adjusted, then both of the suction and motive mass flow rates can be controlled. Consider the following cases:

CASE I: $P_m$ varies, $A_d$ is adjusted, therefore $W_m/W_s$ or $W_s$ can be controlled while $P_m$ and $P_d$ are matched and $P_s$ is adjusted by the system using the ejector (within the designed operating range of the ejector).

CASE II: $P_m$ varies, $A_m$ is adjusted, therefore $W_m/W_s$ or $W_m$ can be controlled while $P_m$ and $P_d$ are matched and $P_s$ is adjusted by the system using the ejector (within the designed operating range of the ejector).

CASE III: $P_m$ varies, $A_d$ and $A_m$ are adjusted, therefore $W_s$ and $W_m$ can be controlled while $P_m$ and $P_d$ are matched and $P_s$ is adjusted by the system using the ejector (within the designed operating range of the ejector).

CASE IV: $P_m$ varies, $A_d$ and $A_m$ are adjusted, $W_s$ or $W_m$ or $W_m/W_s$ is controlled, while $P_m$, $P_d$ and $P_s$ are matched (within the designed operating range of the ejector). One of $W_s$ or $W_m$ is not controlled and must be adjusted by system using ejector.

CASE V: $P_m$ varies, $A_d$ or $A_m$ is adjusted, while $P_m$, $P_d$ and $P_s$ are matched (within the designed operating range of the ejector). Both $W_s$ and $W_m$ are not controlled and must be adjusted by system using ejector.

Notice from Cases I and II, that when only one of $A_d$ or $A_m$ can be adjusted, the mass flow rate at the ejector inlet not being adjusted is uncontrollable by changing $A_d$ or $A_m$.

However, the ratio of mass flow rates at the motive and suction inlets or the mass flow rate at the ejector inlet being adjusted can be controlled. Also note that control of the ratio of inlet mass flow rates is equivalent to control of the ratio of any one of the inlet mass flow rates to the discharge mass flow rate because the discharge mass flow rate is the sum of both inlet mass flow rates. Furthermore, for the same reason control of both inlet mass flow rates is equivalent to control of the discharge mass flow rate. If only one of $A_m$ or $A_d$ is adjusted, the discharge mass flow rate cannot be controlled while matching pressure conditions at ejector inlets and outlet.

The discussion so far has been limited to fixed composition inlet fluid streams at equilibrium conditions. If these restraints are relaxed the adjustable ejector and methods for controlling fluid variables at the ejector openings are still applicable. Either fewer fluid variables can be exactly controlled or the same number of variables can be closely regulated within desired ranges of temperature and average molecular weights. This is particularly true since the dependence of functionals in F and G on composition and temperature is weak or slowly varying. In fact this dependence varies as the square root of the ratios of molecular weights and temperatures for suction and motive fluids (see equation 6-38 on page 6-30 of Perry's Chemical Engineers Handbook, Fourth Edition). The adjustable ejector and methods of this invention are therefore directly adaptable to the following types of fluid situations:

1. Solid-gas flows, especially for suction inlet.
2. Liquid-gas flows of varying compositions.
3. Superheated or subcooled fluids.

These situations are examples where fluid composition and temperature are not determined by fluid pressure alone.

Referring now to FIG. 23, an example of the operation of the present invention is shown schematically. This system illustrates a heating and cooling system driven by a low temperature heat source and utilizing an ejector pump. Further details concerning this device are shown in U.S. Pat. No. 4,248,049.

In the system illustrated in FIG. 23 the fluid conditions in the system and those leading to and from the ejector 170 vary because of the changes in the heat source available to the drive evaporator 173 and varying heat sink and secondary heat load temperatures affecting the condensor 174 and the heat extraction evaporator 175; respectively.

Although there are many ways to monitor the fluid conditions, FIG. 23 illustrates an ejector control 182 which has temperature sensors at the drive evaporator 173, the condensor 174 and a pressure transducer just downstream of the ejector suction inlet 185. Thus, changing temperature and pressure conditions in these locations are automatically monitored by an appropriate microprocessor in the ejector control 182.

When there are changes in the fluid conditions at these three locations where temperature and pressure are monitored, a microprocessor in ejector control 182 receives this information, computes what the necessary adjustments to the system are and sends control signals to the mechanical devices which can make these adjustments. The ejector control 182 for the system as shown in FIG. 23 is designed to send control signals to expansion valve control 183, which adjusts expansion valve 183, to blower control 184 which activates three way valve 181 and regulates blower 180, and to ejector motive inlet nozzle adjustment mechanism 171 and ejector mixing throat mechanism 172. For example, the microprocessor will compute the necessary ejector motive nozzle and mixing throat diameters, and the setting for expansion valve 179 and blower control 184 to ensure that the discharge pressure from ejector 172 matches the pressure required for condensation at the heat sink temperature in the condensor 174. By this means, proper conditions in the system can be automatically and continuously achieved at the ejector external openings. If an ejector is used witout such a control method and control devices, these conditions could not be achieved in the system of FIG. 23 when such system fluid conditions change.

As pressure in the drive evaporator 173 falls, the ejector 170 discharge pressure will decline significantly unless pressure to the ejector suction inlet is raised in expansion tank 176 by adjusting expansion valve 179, by actuating blower 181, or by both adjusting valve 179 and by actuating blower 181. If the discharge pressure declines too far, condensation of the discharged vapor in condensor 174 will not occur and the cooling capability of the system will be adversely affected. Although raising the suction pressure will preclude a large decline in discharge pressure as drive operator 173 pressure falls, the suction pressure will still decline some (but less than if suction pressure were not increased) if an ejector 170 has a fixed nozzle and mixing section throat diameters. If pressure in drive evaporator 173 falls enough, then, eventually ejector discharge pressure will become too low for efficient condensor 174 operation even when ejector suction pressure is increased. Before this condition is reached, however, the ejector suction pressure may be raised to the point where the temperature of refrigerant in expansion tank 176 is too high to give efficient cooling. Furthermore, when ejector motive inlet and suction inlet pressures change, fluid mass rates flows to the drive evaporator 173 and expansion tank 176 will require adjustment to maintain proper levels in the boiler and expansion tank. This flow rate adjustment will mean additional system equipment modifications and expense such as level control devices in drive evaporator 173 and expansion tank 176, or pumps 177 and 178 will need variable speed motors or will need to be turned on and of more frequently, or streams may need branching (with control valves) around drive evaporator 173 and expansion tank 176 to other places in the system.

If the ejector 170 in the system has an adjustable motive nozzle or mixing section throat diameter, then adjustment of one of these diameters and changing ejector suction pressure by turning blower 180 on or off or adjusting expansion valve 179, (or a combination of both actions for blower 180, and valve 179) will permit not only the ejector discharge pressure to the condensor 174 to be maintained during pressure changes in drive evaporator 173 but also will mean that one of the refrigerant gas mass flow rates from drive evaporator 173 and expansion tank 176 can be kept constant.

If both the nozzle and mixing section throat diameters in ejector 170 are adjustable, then changing both of these ejector diameters and the ejector suction pressure by turning blower 180 on or off or adjusting expansion valve 179 (or a combination of both actions for blower 180 and valve 179) will permit not only the ejector discharge pressure to the condensor 174 to be maintained, but also that both of the two refrigerant gas mass flow rates from drive evaporator 173 and expansion tank 176 can be kept constant. Note that blower 180 alone can be used to increase ejector suction pressure without adjustment of expansion valve 179; and the temperature of refrigerant in expansion tank 176 can be kept constant at a lower temperature. But without the use of an adjustable ejector 170, refrigerant gas mass flow rates from the drive evaporator 173 and expansion tank 176 cannot be kept constant. If only the expansion valve 179 is adjusted to provide higher suction pressure with declining drive evaporator 173 pressure, then the refrigerant temperature in expansion tank 176 will rise and cooling can only be provided at higher temperatures. However, when an adjustable ejector 170 and blower 180 are used both the mass flow rate and temperature of refrigerant in expansion tank 176 can be kept constant at a lower temperature for changes in the pressure in drive evaporator 173 and ejector motive inlet without adjustment of expansion valve 179.

Using the methods and knowledge for controlling ejector inlet and outlet conditions, an ejector can also be constructed which is self-adjusting or self-controlling to achieve desired conditions at one or more of the ejector openings when conditions at ejector openings change. Such a self-adjusting ejector is feasible when an inflatable torus is used as an adjustment means for nozzle or mixing section throat diameters. In this embodiment, the pressurized fluid source for the hydraulic line supplying the torus can be connected near (or at) the ejector motive inlet or near (or at) the ejector discharge (when a diffuser is provided at the ejector discharge). The pressure of fluid at these source locations is high enough to inflate the torus. Torus material can be selected which has the proper stress and deformation characteristics so that the torus will inflate and deflate with changes in the pressure difference between the inside (at the hydraulic source pressure) and the outside (at the ejector suction or discharge pressure) of the torus. In this way, an ejector can be constructed to be self-adjusting in the sense that changes in the fluid pressure at either the motive inlet or discharge will cause changes in the torus diameter (inflation or deflation) and result in control of the pressure or mass flow rate at the ejector opening where the torus is located. Also if the motive inlet nozzle and mixing section throat are both adjusted by a torus, one hydraulic line (not shown) can be used to connect a torus at one location with a torus in the other location to control the fluid conditions at one or both locations. In this case, the two toruses and hydraulic line would form a closed system balancing pressure changes on the outside of one torus by pressure changes and inflation or deflation at the other torus.

In general a torus at the outlet of the motive nozzle can be inflated either by fluid from the inlet to the nozzle or by fluid from the ejector diffusor discharge section. Note that the discharge pressure can be high enough to inflate a torus at the outlet of the motive inlet nozzle because the fluid pressure at the nozzle outlet is close to the ejector suction pressure which is usually muchless than the ejector discharge pressure when a diffusor is used. Also a torus at the mixing section throat can be inflated by fluid from either the inlet or discharge side of the ejector (from the discharge side only when a diffuser section is attached downstream of the mixing section to increase discharge pressure). When a torus is used to open or close a splined motive nozzle or mixing section, the same self adjusting capabilities described above for non-splined adjustment parts can be achieved. In this case however, there are also spring type forces in the splined nozzle or splined mixing section (or split mixing section with springs) acting to oppose inflation of the torus. To achieve proper response to pressure source changes by the torus material, these additional spring type forces must be taken into account by selection of torus material having different stress and deformation properties.

Consider the operation of a self adjusting ejector where a torus is used to adjust either the motive nozzle throat or mixing section throat or the ejector and where the torus is supplied with a high pressure fluid via a hydraulic line connected to the ejector inlet conduit. If the pressure of fluid in the inlet conduit decreases, the pressure of fluid in the hydraulic line and torus will therefore decrease. When the pressure inside the torus decreases, the difference in pressure between the inside and outside of the torus also decreases. This reduces the tensile stresses in the torus and causes the torus to shrink or deform inward (deflate) with the result that the mixing section throat or nozzle throat diameter is increased. The amount of the throat diameter increase (or decrease) will be determined by the response (deformation) characteristics of the torus material to changes in pressure difference between the inside and outside of the torus (as well as spring forces if the torus is used on the outside of splined adjustment parts). Torus material with different deformation response characteristics can be selected to achieve the correct amount of diameter change needed as predicted by the control methods described earlier for controlling pressure and flow rate conditions at the ejector opening near the torus location.

Putting an orifice or pressure regulating valve in the hydraulic line coupled with proper hydraulic line sizing can ensure that any rapid pressure changes will be dampened and that the amount of torus expansion or contraction will be controlled.

In many of the above-described embodiments welds or threads necessary for construction or assembly are not shown for the sake of simplicity. These features and the simple details of assembly are well within the skill of those in the art of mechanical construction.

Thus, the adjustable ejector and the method of adjustment of the present invention are well adapted to attain the objects and advantages mentioned as well as those inherent therein. While presently preferred embodiments of the invention have been described for the purpose of this disclosure, numerous changes in the construction and arrangement of parts can be made by those skilled in the art, which changes are emcompassed within the spirit of this invention as defined by the appended claims.

The foregoing disclosure and the showings made in the drawings are merely illustrative of the principals of this invention and are not to be interpreted in a limiting sense.

What is claimed is:

1. An adjustable ejector for adjustably controlling fluid flow conditions resulting from fluid flow through the ejector comprising:

an ejector housing having therein a motive inlet including an inlet nozzle, a suction inlet, and a mixing and outlet zone wherein mixing of fluid from said motive inlet and said suction inlet occurs and then exits from the ejector, including a mixing throat;

adjustment means for varying the fluid presentation size of said inlet nozzle and of said mixing throat such that fluid flow conditions with respect to said motive inlet, suction inlet, and mixing and outlet zone can be controlled thereby, said adjustment means including an adjustable fluid path structure disposed in each of said inlet nozzle and said mixing throat, said adjustable fluid path structure of said inlet nozzle comprising;

an inflatable torus capable of inflation and deflation by hydraulic fluid and disposed for receiving and conveying fluid passing into and through said inlet nozzle;

an hydraulic conduit extending from said hydraulic torus for conveying hydraulic fluid to and from said torus; and means for pumping hydraulic fluid through said conduit to and from said torus for inflating and deflating said torus.

2. An adjustable ejector for adjustably controlling fluid flow conditions resulting from fluid flow through the ejector comprising:

an ejector housing having therein a motive inlet including an inlet nozzle, a suction inlet and a mixing and outlet zone wherein mixing of fluid from said motive inlet and said suction inlet occurs and then exits from the ejector, including a mixing throat;

segmented throat conduit means for conveying fluid inside said ejector;

segment movement means disposed between said segmented conduit means and said ejector housing for expanding and contracting to move said segmented throat conduit in a manner changing the fluid presentation size ratio of the said inlet nozzle to the said mixing throat, the segment movement means comprising:

an inflatable torus capable of inflation and deflation by hydraulic fluid and disposed around said segmented throat conduit means; and hydraulic conduit means extending from said inflatable torus for conveying hydraulic fluid to and from said inflatable torus for inflation and deflation of said torus.

* * * * *